US008001905B2

(12) United States Patent
Webster et al.

(10) Patent No.: US 8,001,905 B2
(45) Date of Patent: Aug. 23, 2011

(54) MODEL VEHICLE WITH AUTOMATED PANTOGRAPH

(75) Inventors: Richard F. Webster, Carson, CA (US); Steven R. Greening, Grosse Pointe Woods, MI (US)

(73) Assignee: Lionel L.L.C., Chesterfield, MI (US)

( * ) Notice: Subject to any disclaimer, the term of this patent is extended or adjusted under 35 U.S.C. 154(b) by 1454 days.

(21) Appl. No.: 11/136,838

(22) Filed: May 24, 2005

(65) Prior Publication Data

US 2006/0060105 A1 Mar. 23, 2006

Related U.S. Application Data

(60) Provisional application No. 60/575,267, filed on May 28, 2004.

(51) Int. Cl.
*B60L 5/00* (2006.01)

(52) U.S. Cl. ..... 105/1.5; 105/26.05; 105/49; 191/66; 191/85

(58) Field of Classification Search ..... 105/1.5, 105/26.05, 157.2, 49; 446/454; 191/66, 191/85, 83, 50

See application file for complete search history.

(56) References Cited

U.S. PATENT DOCUMENTS 3,238,314 A * 3/1966 Faiveley ..... 191/66
5,322,469 A * 6/1994 Tilbor ..... 446/454
6,457,681 B1 * 10/2002 Wolf et al. ..... 246/187 A

* cited by examiner

*Primary Examiner* — Mark T Le
(74) *Attorney, Agent, or Firm* — O'Melveny & Myers LLP

(57) ABSTRACT

A model vehicle, such as a model electric train, includes a model pantograph. The operation of the pantograph is automated using a motor, drive train, and control circuit. An upper articulating portion of the pantograph is mounting to the model vehicle using a breakaway assembly. The upper articulating portion may also be coupled to a drive motor via an elastic coupling permitting elastic movement of the upper portion independently of the drive motor.

6 Claims, 5 Drawing Sheets

MODEL VEHICLE WITH AUTOMATED PANTOGRAPH

CROSS-REFERENCE TO RELATED APPLICATION

This application claims priority pursuant to 35 U.S.C. §119 (e) to U.S. Provisional Application No. 60/575,267, filed May 28, 2004, which application is specifically incorporated herein, in its entirety, by reference.

BACKGROUND OF THE INVENTION

1. Field of the Invention

The present invention relates to electric-powered model vehicles, such as model trains, and more particularly, to a pantograph for a model train or other model vehicle.

2. Description of Related Art

Various model trains and vehicles are known in the art, which model an actual or imaginary train or vehicle at a reduced scale. In a typical model layout, a model train having an engine is provided. The model train engine includes an electrical motor that receives power from a voltage that is applied to model railway tracks. A transformer is used to apply the power to the tracks, while contacts (e.g., a roller) on the bottom of the train, or metallic wheels of the train, pick up the applied power for the train motor. In some model train layouts, the transformer controls the amplitude, and in a DC system, the polarity, of the voltage, thereby controlling the speed and direction of the train. In HO systems, the voltage is a DC voltage. In O-gauge systems, the track voltage is an AC voltage transformed by the transformer from a household line voltage provided by a standard wall socket, such 120 or 240 V, to a reduced AC-voltage, such as 0-18 volts AC.

Some model train engines include a model pantograph. In full-scale electric vehicles such as electric trains and trolleys, a pantograph is a roof-mounted device on an electric car or locomotive that collects electric current from an overhead catenary. Usually a pantograph can be raised or lowered to make or break a connection with the catenary. Trains having pantographs have been known and functional for years in real-world railroading, and also known and functional to a lesser degree in model railroading. In model railroading, pantographs are mainly used to achieve a more realistic appearance, and may not be fully operational. Some model trains have pantographs that may be fixed in a raised position, or that may be manually adjustable so that a user can raise or lower the pantograph as he wishes.

However, model trains with pantographs may be subject to certain limitations. For instance, pantographs on model trains are not automatically adjustable, unlike pantographs on full-scale vehicles, which may be raised and/or lowered depending on the direction the train is traveling. Therefore, vehicles with pantographs may not be modeled as accurately as desired. For further example, prior-art model pantographs are rigidly coupled to model trains such that it is relatively easy to damage the moveable raised portion of the pantograph during normal handling.

Accordingly, a need exists for a model train with pantograph that overcomes these and other limitations of the prior art.

SUMMARY OF THE INVENTION

The invention provides a model vehicle with an automatically adjustable pantograph. The automatically adjustable pantograph comprises a plurality of cooperating arms in an upper portion of the pantograph. The cooperating arms may be articulated to raise and lower a collector unit for collecting power from an overhead line, or for simulating the collection of power. Movement of the upper portion of the pantograph may be driven by a motor. The motor is controlled by a controller executing a control program. The motor may be activated in response to control signals received by a receiver on board the model vehicle, or in response to other input, such as automatic input from a trackside accessory.

In an embodiment of the invention, the motor drives the upper portion of the pantograph via a gear train in a lower portion of the pantograph. The lower portion of the pantograph may be mounted to the model vehicle. The gear train may be operably associated with the upper portion of the pantograph via an elastic coupling. The elastic coupling may be configured to transmit the movement of the gear train to the articulating arms of the upper portion, while also permitting a degree of manual movement of the articulating arms without damaging the gear train or other mechanical components of the pantograph.

In an embodiment of the invention, the pantographic is mounted to the model vehicle using a breakaway mount. If excessive force is applied to the upper portion of the pantograph during handling or during operation, the upper portion separates from the model vehicle. Damage to the upper portion of the pantograph may thereby be avoided. After being separated, the upper portion is easily reattached and the pantograph can be operated normally. The breakaway mount may be used in combination with motorized components for automatic operation.

A more complete understanding of the model vehicle with pantograph will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides a model vehicle with automated model pantograph, that overcomes the limitations of the prior art. In the detailed description that follows, like element numerals are used to indicate like elements appearing in one or more of the figures.

Figure 1:
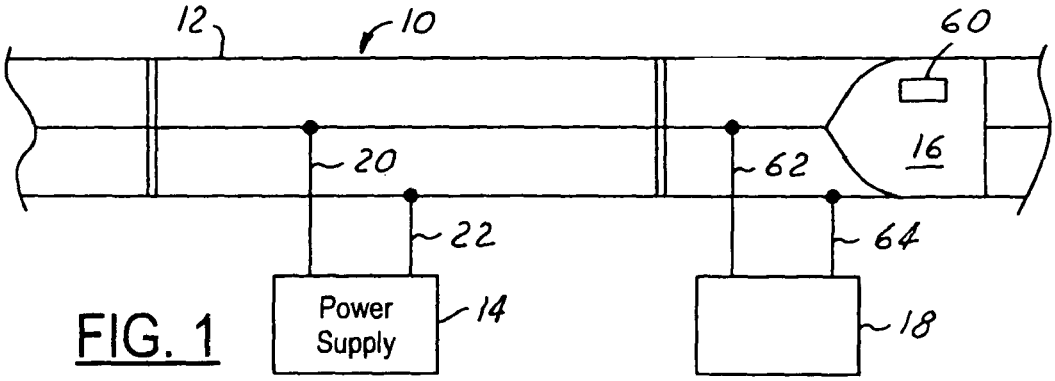
FIG. 1 is a schematic view of a model vehicle system in accordance with the present invention.

FIG. 1 shows a first exemplary embodiment of a model vehicle system, such as a model railroad system 10. The model vehicle system illustrated in the drawings and to be described herein is that of a model railroad. It should be noted, however, that the inventive model vehicle is not limited to such form or systems, but rather can be used in connection with any number of model systems. Accordingly, the use of a model railroad herein is for exemplary purposes only and is not meant to be limiting in nature.

Model train system 10 includes a track 12, a power supply 14, a train 16 and a control circuit 18. In an exemplary embodiment, track 12 is a three rail track. Power source 14 provides power to track 12 by way of connectors 20 and 22. The power terminal of the power supply is connected to the center or third rail of track 12 by connector 20 and the neutral terminal is connected to at least one of the two outer rails of track 12 by connector 22. Train 16 may be configured with contacts on the bottom of the train 16 or an arrangement of electrically conductive metallic wheels to pick up the applied power and supply it to the electric motor of train 16. Power source 14 may comprise a conventional AC or DC transformer, depending on the requirements of railroad layout 10, and in particular, model train 16. Additionally, power source 14 may provide a fixed output, a variable output, or both. In an exemplary embodiment, railroad layout 10 is an O-gauge layout and power source 14 is an AC transformer which transforms typical AC line voltage (e.g., 120 VAC) to a reduced level (e.g., 0-18 VAC for a conventional O-gauge variable output model train transformer) and supplies the same to track 12.

Figure 2:
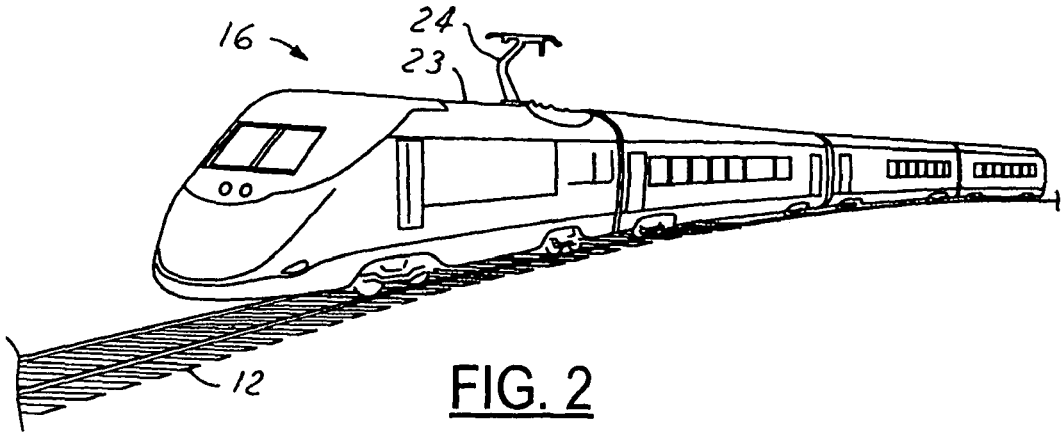
FIG. 2 is a perspective view of a model train with pantograph in accordance with the present invention.
Figure 3:
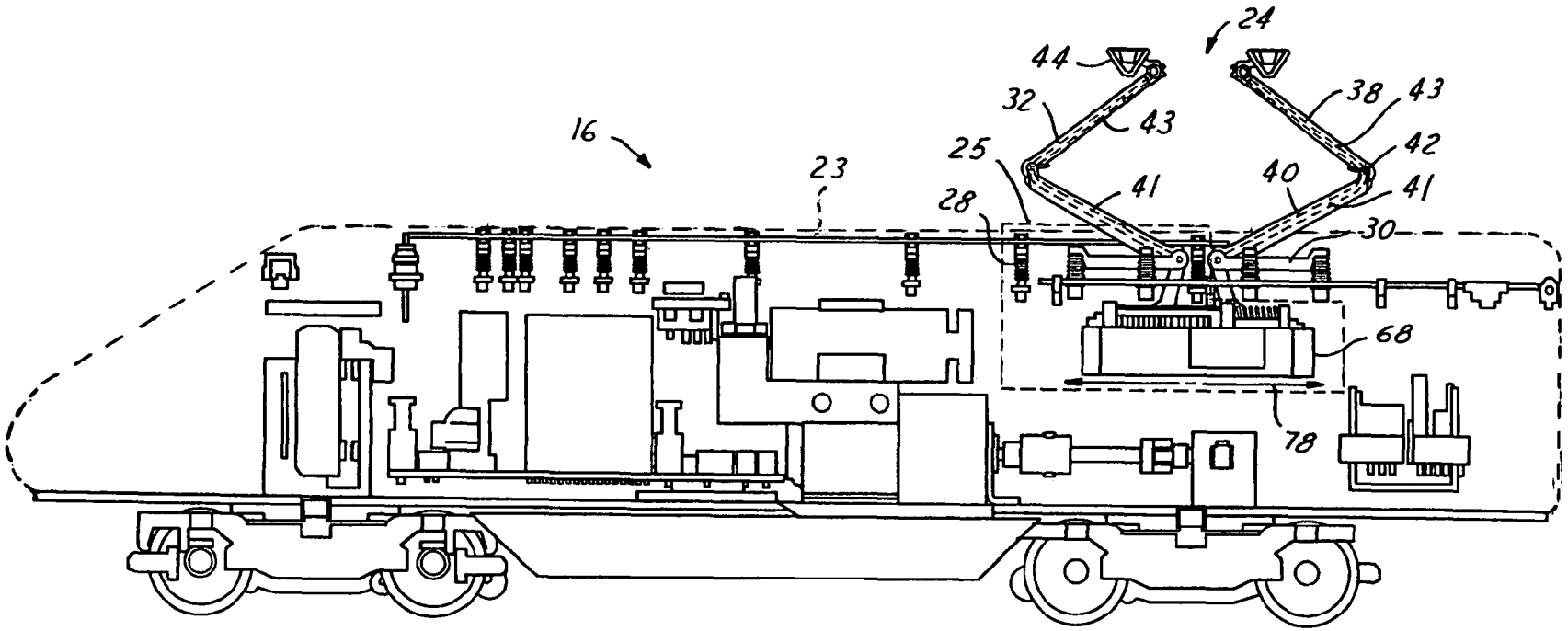
FIG. 3 is a side elevation view showing interior components of a model locomotive with pantograph in accordance with the present invention.
Figure 4:
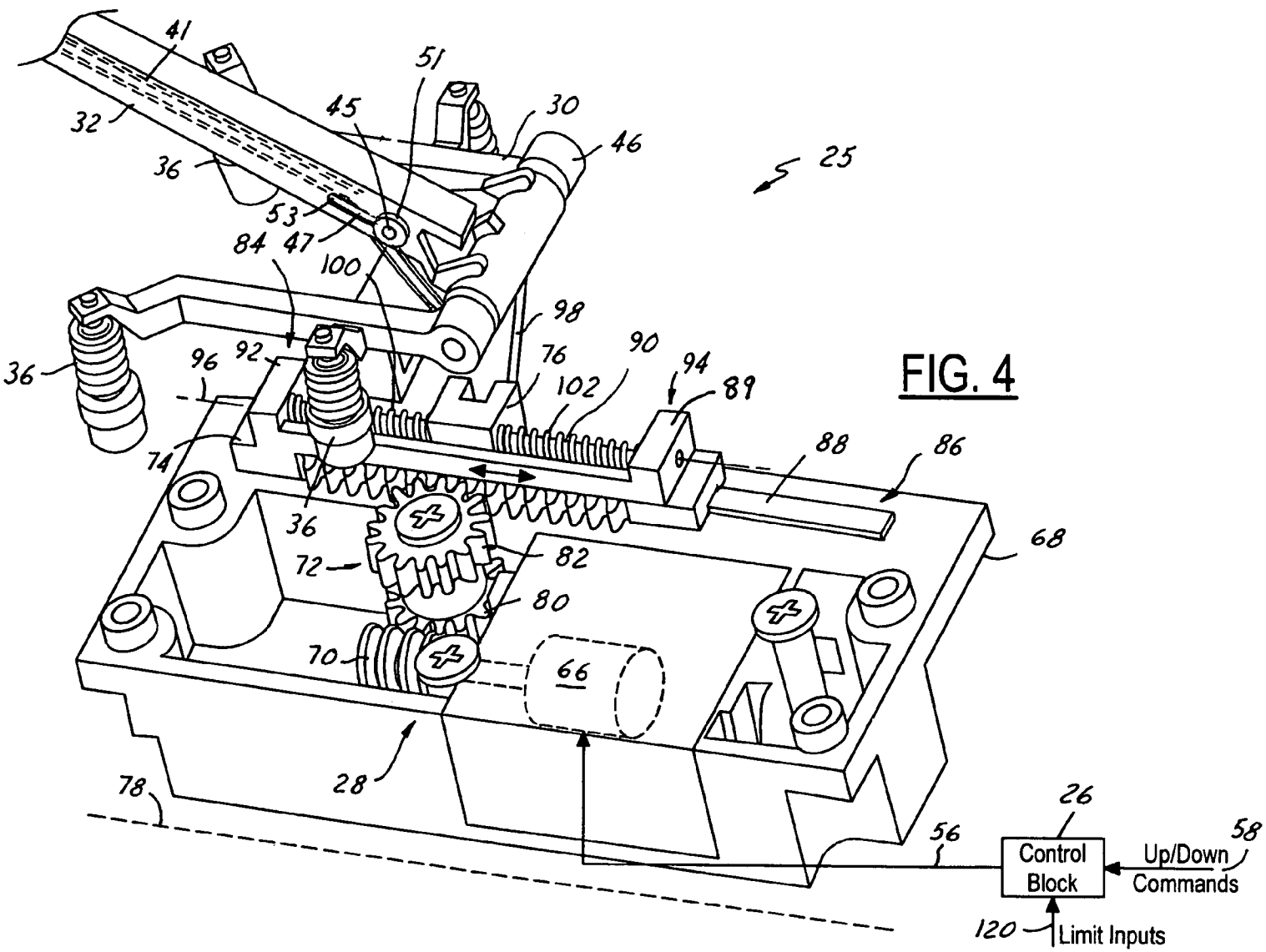
FIG. 4 is an enlarged perspective view of a portion of a pantograph of the model train of FIG. 3 in accordance with the present invention.

With reference to FIGS. 2-4, train 16 includes a main body 23, an adjustable pantograph 24, a control block 26, and a driver mechanism 28. With reference to FIGS. 3 and 4 in particular, pantograph 24 includes a stationary portion 30 and an articulating upper portion 32. Stationary portion 30 is configured for mounting pantograph 24 on train 16, and main body 23 of a locomotive of train 16 in particular. In an exemplary embodiment, stationary portion 30 comprises a plurality of legs 36 (for example, four legs) that are configured to be affixed to train 16. Stationary portion 30 may be affixed to main body 23 using known methods, such as, for example, inserting the legs into corresponding bores on train 16, screwing the legs into corresponding screw holes in main body 23, or any other suitable method. Stationary portion 30 is also configured for coupling with articulating upper portion 32, as will be described in greater detail below.

With continued reference to FIGS. 3-5*a*, a portion 25 of pantograph 24 is depicted. Articulating upper portion 32 is pivotally coupled to stationary portion 30 and is configured for movement between a raised (extended) and a lowered (collapsed) position. Articulating upper portion 32 includes an upper arm 38 and a lower arm 40. Articulating upper portion 32 comprises a plurality of articulating arms 38, 40. The upper portion further includes a link 42 connecting upper arm 38 to lower arm 40 in such a manner so as to allow upper arm 38 to articulate relative to lower arm 40. The movement of upper arm 38 relative to lower arm 40 may be accomplished as follows. Lower arm 40 may comprise a connecting rod 41 positioned within the structure of lower arm 40, and upper arm 38 may comprise a connecting rod 43 positioned within the structure of upper arm 38. Connecting rods 41, 43 may be coupled together by way of link 42. Connecting rod 41 may comprise a pin 45 integral therewith and disposed within an elongated slot 47 in lower arm 40. Pin 45, and therefore connecting rod 41, is configured to be coupled to stationary portion 30 of pantograph 24 by way of a linking arm 49.

As will be discussed in greater detail below, linking arm 49 may be coupled to stationary portion 30 by way of a breakaway assembly 46. In operation, as lower arm 40 is raised, pin 45 rides toward a first end 51 of slot 47, causing connecting rod 41 to be pulled toward in the direction of stationary portion 30. As connecting rod 41 is pulled, it causes connecting rod 43 of upper arm 38 to also be pulled, thereby causing upper arm 38 to extend and raise. Similarly, as lower arm 40 is collapsed or lowered, pin 45 rides within slot 47 towards a second end 53 of slot 47 opposite first end 51. As pin 45 rides within slot 47, connecting rod 41 is pushed away from stationary portion 30, thereby causing connecting rod 43 of upper arm 38 to likewise be pushed, resulting in the lowering of upper arm 38.

Articulating upper portion 32 may further comprise a projection 44 (best shown in FIG. 3) attached to a distal end of each upper arm 38. Projection 44 may be coupled to upper arm 38 by way of a connecting link and is configured to resemble a current collector that, in actual trains, makes contact with the overhead electrical wires of the train system, thereby providing power to the train.

With reference to FIGS. 3 and 4, and FIG. 4 in particular, driver mechanism 28 of train 16 is depicted. Driver mechanism 28 may comprise a motor 66, such as, for example, a bi-directional DC motor, that is operative to move articulating upper portion 32 of pantograph 24 between raised and lowered positions in response to control signal 56. In an exemplary embodiment, driver mechanism 28 may comprise a base 68, a worm gear 70, a gear set 72, a rack 74, and a traveler 76. In the exemplary embodiment, base 68 houses motor 66 and is configured to be mounted within train 16, and main body 23 in particular, thereby defining a longitudinal plane 78. Worm gear 70, which comprises metal in an exemplary embodiment, may be oriented so as to be parallel with longitudinal plane 78 and in mesh with and driven by an output shaft of motor 66. In an exemplary embodiment, worm gear 70 may also be housed within base 68.

Gear set 72 may comprise a first gear 80, a second gear 82, and a shaft positioned therebetween to couple gear 80 and gear 82 together. In an exemplary embodiment, gear 80 may comprise a spur gear made of a molded plastic material and may be driven by worm gear 70. Second gear 82 may comprise a spur gear made of a plastic material and may be in mesh with rack 74. Although gear set 72 includes a pair of gears, this arrangement is exemplary only and not limiting in nature. The number, type and material of gears comprising gear set 72 may vary. In an exemplary embodiment, at least a portion of gear set 72 may be housed within base 68.

With continued reference to FIGS. 3 and 4, rack 74 may be mounted on base 68. Rack 74 may comprise gear teeth extending along a horizontal extent of rack 74 that are in mesh with a gear of gear set 72, such as second gear 82. Accordingly, rack 74 and gear 82 may be arranged such that rotation of gear 82 operates to impart movement onto rack 74 between a first position 84 and a second position 86 along longitudinal plane 78 of base 68.

Rack 74 may be mounted on a guide 88, which, in turn, may be part of and integral to base 68. Guide 88 may extend along longitudinal plane 78 and serves as a track or guide for rack 74 as it moves between first position 84 and second position 86. Rack 74 may be operatively coupled to a frame 89. Frame 89 may support a rod 90 extending longitudinally from a first end 92 to a second end 94 of rack 74. Rod 90 may be oriented along longitudinal axis 96 that is parallel to plane 78. Traveler 76 may be disposed upon rod 90 and may be configured to slide along the longitudinal axis 96 of rod 90 independently of rack 74. Traveler 76 may be further configured with an arm 98 extending therefrom that is coupled to articulating upper portion 32 of pantograph 24 so as to link driver mechanism 28 to articulating upper portion 32.

With continued reference to FIGS. 3 and 4, driver mechanism 28 further includes a first compression spring 100 and a second compression spring 102. First and second compression springs 100, 102 may be placed over rod 90 such that springs 100, 102 surround rod 90. First spring 100 may be positioned between traveler 76 and first end 92 of rack 74, and second spring 102 may be positioned between traveler 76 and second end 94 of rack 74. In this arrangement, the compression force of springs 100, 102 is such that the springs are operative to hold articulating upper portion 32 in a raised position when pantograph 24 is raised. The arrangement of compression springs 100, 102 further allow for pantograph 24 in a raised position to be manually pushed down (i.e., lowered) or pulled up (i.e., raised) without breaking. In this instance, the springs would either compress or extend when the pantograph 24 is pushed or pulled, and would then recoil or extend when the pressure put on the pantograph is released. Accordingly, when the pantograph 24 is raised, a user can put pressure on the raised portion of the pantograph to cause it to lower, and then release it, which will cause the pantograph to spring back to a raised position. Various other arrangements of springs or other elastic members may also be suitable for use in biasing an output of the motorized drive unit, for example, one or more tension springs or torsion springs may also be suitable.

Figure 5A:
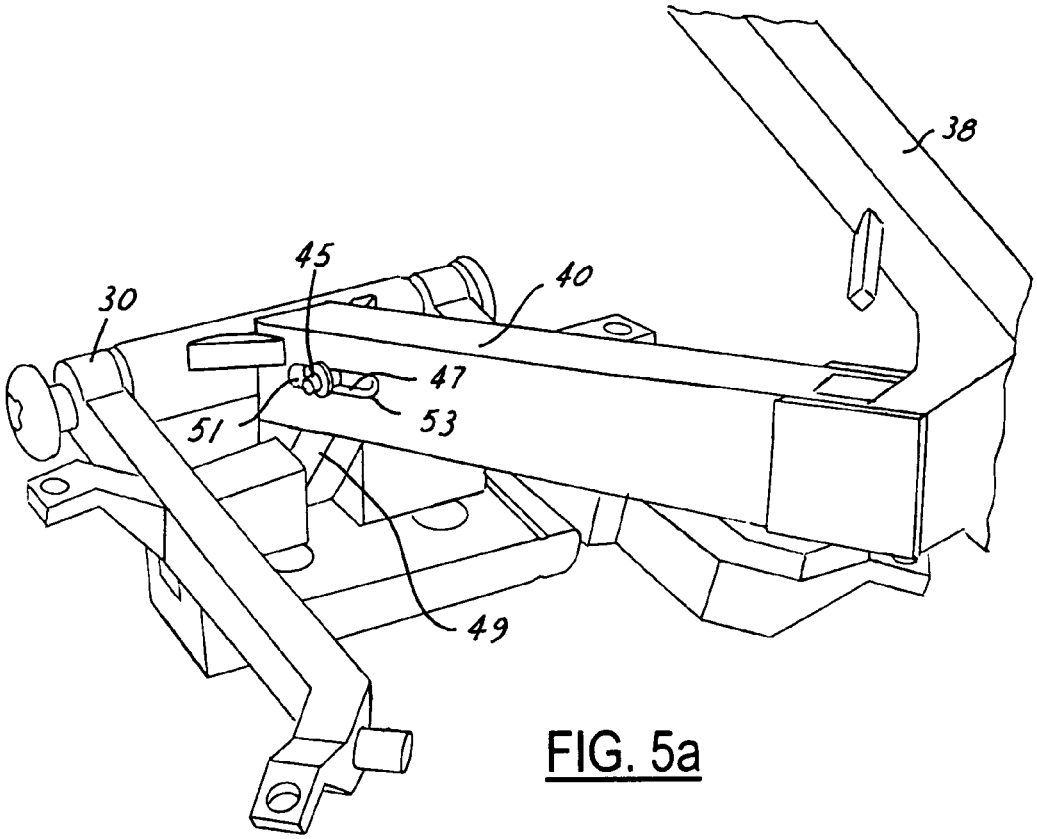
FIGS. 5*a*-5*b* are perspective views of an exemplary breakaway assembly of the pantograph in accordance with the present invention.
Figure 5B:
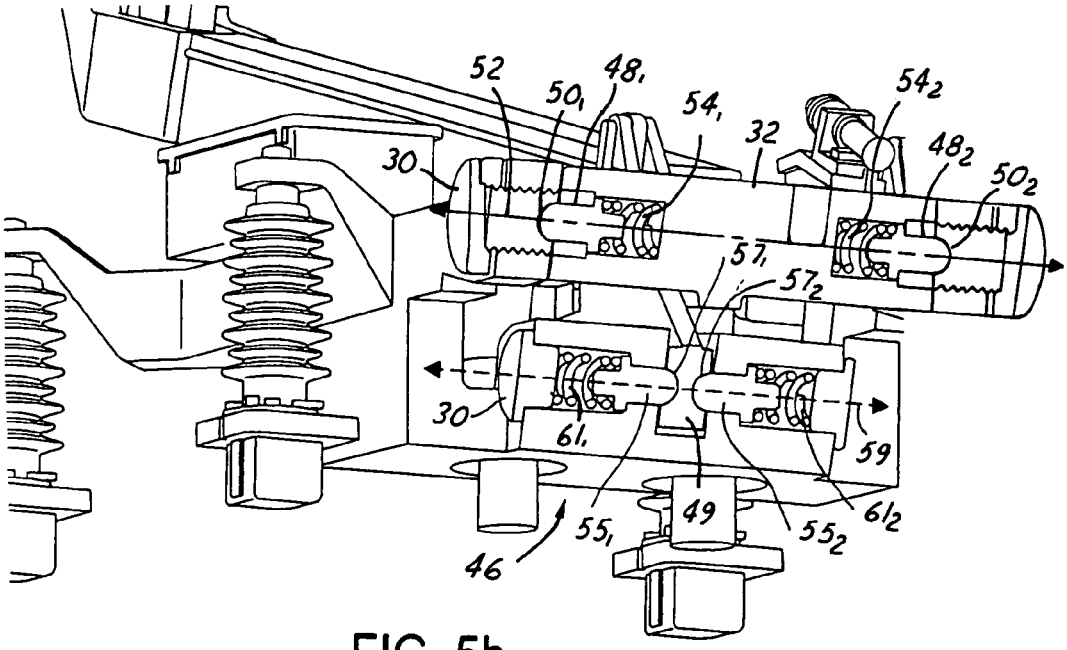

With reference to FIGS. 3-5*b*, in an exemplary embodiment, stationary portion 30 and articulating upper portion 32 are pivotally coupled together by way of a breakaway assembly 46. With particular reference to FIGS. 5*a*-5*b*, breakaway assembly 46 may be configured to allow articulating upper portion 32 to rotate or pivot relative to stationary portion 30 and to be separated from stationary portion 30 when a force applied to the upper portion exceeds a threshold amount. Breakaway assembly 46, in an exemplary embodiment, comprises two pairs of spring loaded pins $\mathbf{48}_1$, $\mathbf{48}_2$, and $\mathbf{55}_1$, $\mathbf{55}_2$. First pair of spring loaded pins $\mathbf{48}_1$, $\mathbf{48}_2$ may be disposed within lower arm 40 of articulating upper portion 32, and may have a rounded or beveled distal end configured to be received in a pair of corresponding detents or blind bores $\mathbf{50}_1$, $\mathbf{50}_2$ formed on stationary portion 30. Second pair of spring loaded pins $\mathbf{55}_1$, $\mathbf{55}_2$ may be disposed on stationary portion 30, and likewise may be configured to be received in a pair of blind bores $\mathbf{57}_1$, $\mathbf{57}_2$ in linking arm 49.

Breakaway assembly 46 may define a first longitudinal axis 52 associated with and extending through pins $\mathbf{48}_1$, $\mathbf{48}_2$ and bores $\mathbf{50}_1$, $\mathbf{50}_2$, and a first pair of compression springs $\mathbf{54}_1$, $\mathbf{54}_2$ acting along axis 52. Assembly 46 may be oriented such that forces applied between the articulating upper portion and the stationary portion are radially directed with respect to pins $\mathbf{48}_1$, $\mathbf{48}_2$. It should be noted that while an arrangement wherein spring loaded pins $\mathbf{48}_1$, $\mathbf{48}_2$ are disposed on articulating upper portion 32 and bores $\mathbf{50}_1$, $\mathbf{50}_2$ are formed on stationary portion 30, the opposite arrangement is also a viable arrangement that remains within the spirit and scope of the present invention. Numerous other combinations of elastically-biased mating connectors may also be readily adapted for use with the invention.

Similarly, breakaway assembly 46 may define a second longitudinal axis 59 parallel to first longitudinal axis 52 and associated with and extending through pins $\mathbf{55}_1$, $\mathbf{55}_2$ and bores $\mathbf{57}_1$, $\mathbf{57}_2$, as well as a second pair of compression springs $\mathbf{61}_1$, $\mathbf{61}_2$ acting along axis 59. Again, assembly 46 may be oriented such that force applied between the raiseable and stationary portions is radially directed with respect to pins $\mathbf{55}_1$, $\mathbf{55}_2$. As discussed above, the disclosed pin-and-bore connector merely exemplifies a suitable reversible connector for use in a breakaway assembly. Numerous other such connectors may be suitable, and may be arranged in various different arrangements, according to the ordinary skill of a designer.

Figure 6:
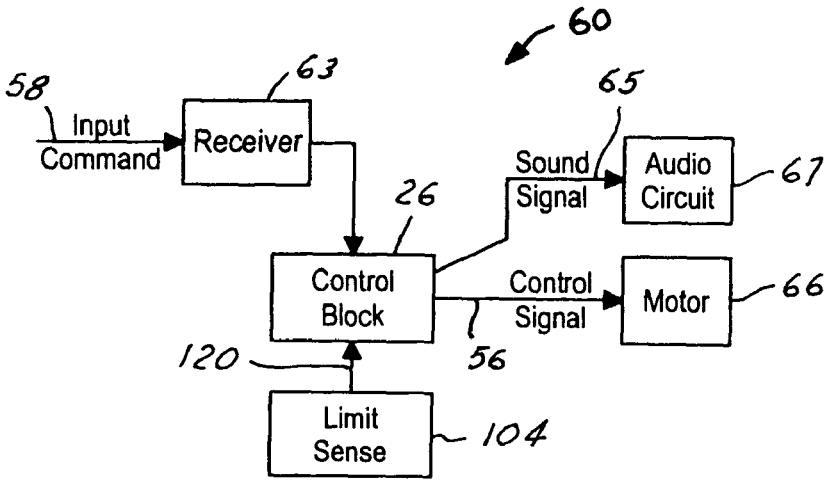
FIG. 6 is a schematic block diagram of an exemplary control system for a model vehicle in accordance with the present invention.

With reference to FIG. 6 (see also FIG. 4), control block 26 is operative to generate a control signal 56 to motor 66 in response to an input command 58, which can be received by way of a receiver 63 that is separate from control block 26 or that is integral therewith, to raise or lower articulating upper portion 32 of pantograph 24, and to deliver control signal 56 to driver mechanism 28. Control block 26 is configured to receive input signals and emit output signals, and in an exemplary embodiment, includes a micro controller. In an alternate exemplary embodiment, control block 26 includes a micro processor unit to carry out the same functionality. In an exemplary embodiment, control block 26 is part of a control circuit 60 onboard train 16.

Control circuitry 60 is operative to receive input signals corresponding to one of a number of onboard train features, such as, for example, sounds and lights, and to generate control signals to activate or deactivate the corresponding feature. Control block 26, and control circuitry 60 as a whole, may receive input command 58 in a number of ways. For example, control circuit 18 may be connected to track 12 by way of connectors 62 and 64. Connector 62 connects control circuit 18 to the center rail of track 12, while connector 64 connects control circuit 18 to a neutral rail of track 12. Control circuit 18 receives the user commands and then transmits those input commands 58 to control block 26 by way of track 12.

One method for transmitting these input commands 58 may comprise superimposing DC offsets on the AC voltage signal supplied to track 12 by power source 14. In this mode, when control block 26 detects a DC offset, it generates control signal 56 to activate or deactivate the corresponding feature. This conventional protocol comprises sending positive and negative DC offsets to control block 26. The different polarities and amplitudes of the DC offsets may correspond to different features of train 16, and accordingly, may each be operative to activate at least one of the features. Accordingly, control circuit 18 may receive input from a selection device, such as a push button, that a user can use to select the desired feature and functionality.

A second approach is to use a so-called command control. The techniques of this protocol have been applied to model trains. For example, U.S. Pat. Nos. 5,251,856, 5,441,223 and 5,749,547 to Young et al. disclose providing a digital message, which may include a command, to a model vehicle using various techniques. The digital message(s) so produced may be received and interpreted by control block 26, which then executes the command by generating control signal 56.

Any suitable communication protocol may be used to activate and deactivate features, such as for example, pantograph 24, by remote control. For example, a user may command pantograph 24 to be raised using a remote control, which sends a signal to control circuit 18, which then sends the digital message along track 12, which is then picked up by control block 26 on train 16. A user may also select the desired action by way of a selection device operably associated with trackside control circuit 18, which then transmits the digital input command signal 58 along track 12 to control block 26. It is foreseeable that a user may also send input command signal 58 by way of remote control to control block 26 directly, thereby bypassing control circuit 18 altogether. It should be noted, however, that these input command signal generation and receiving approaches are provided for exemplary purposes only and not meant to be limiting in nature. Those skilled in the art will appreciate that any approach wherein a command can be generated, transmitted, and received will be suitable for the above described purpose.

With reference to FIG. 6, control block 26 may be further configured to generate a sound control signal 65 so that sounds corresponding to the operation of pantograph 24 are played as the pantograph moves. To carry out this functionality, control block 26, in an exemplary embodiment, receives input command 58 from receiver 63 that is part of control circuitry 60. In response to input command 58, sound control signal 65, which takes one of three different forms, is generated by control block 26. Sound control signal 65 may comprise a signal indicating pantograph 24 is being commanded to raise, a signal indicating pantograph 24 is being commanded to lower, or a signal indicating that movement of pantograph 24 has ceased. Sound control signal 65 is received by an audio circuit 67, which may be part of control circuitry 60, which then causes sounds stored in a memory of the audio circuit 67 and corresponding to each of the raising and lowering of pantograph 24, to be played or stopped, depending on the form of sound control signal 65 received.

Figure 7:
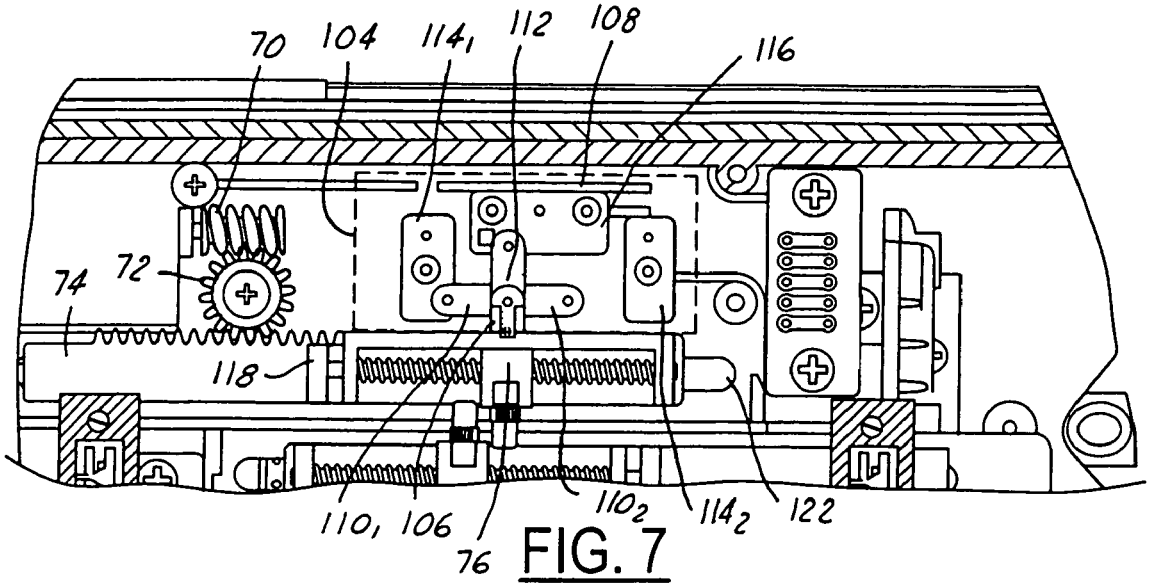
FIG. 7 is a plan view of a drive mechanism of a pantograph for a model vehicle in accordance with the present invention.

With reference to FIGS. 6 and 7, model train 16 may further include a limit sense assembly 104. Limit sense assembly 104 may be electrically coupled to control block 26 and operative to discontinue control signal 56 when articulating upper portion 32 of pantograph 24 reaches one of the raised and lowered positions. In an exemplary embodiment, limit sense assembly 104 includes an electrical contact member 106 and an electrical contact block 108. Electrical contact member 106 may include first and second electrically positive contacts $\mathbf{110}_1$, $\mathbf{110}_2$, and a first neutral contact 112. Further, contact member 106 may be affixed to rack 74 such that contact member 106 travels with rack 74. Electrical contact block 108, on the other hand, is stationary and is disposed upon base 68 along longitudinal plane 78. Contact block 108 may include first and second electrically positive contacts $\mathbf{114}_1$, $\mathbf{114}_2$, corresponding to first and second positive contacts $\mathbf{110}_1$, $\mathbf{110}_2$ of contact member 106, respectively, and a neutral contact 116 corresponding to neutral contact 112 of contact member 106.

As shown in FIG. 7 (see also FIGS. 4, 5), electrical contact member 106 and electrical contact block 108 may be arranged such that as rack 74, and therefore, contact member 106, move towards and reaches a predetermined first travel limit 118, first positive contact $\mathbf{110}_1$ of contact member 106 makes electrical contact with first positive contact $\mathbf{114}_1$ of contact block 108, while neutral contact 112 of contact member 106 makes electrical contact with neutral contact 116 of contact block 108. When this occurs, an electrical circuit is completed and a limit signal 120 indicative of the reaching of first travel limit 118 is generated and sent to control block 26. Control block 26 then discontinues control signal 56, thereby causing motor 66, and therefore, rack 74 to stop moving. Similarly, contact member 106 and contact block 108 are arranged such that as rack 74 moves towards and reaches a predetermined second travel limit 122, second positive contact $\mathbf{110}_2$ of contact member 106 and second positive contact $\mathbf{114}_2$ of contact block 108 make electrical contact, while neutral contacts 112, 116 of contact member 106 and contact block 108, respectively, also make electrical contact, thereby completing an electrical circuit. As described above, a limit signal 120 indicative of the reaching of second travel limit 122 is generated and sent to control block 26. Control block 26 then discontinues control signal 56 supplied to motor 66, thereby ceasing movement of motor 66, and therefore, rack 74. It should be noted that this structure and configuration is provided for exemplary purposes only and is not meant to be limiting in nature. Those skilled in the art will recognize that other limit sense assemblies having the same functionality remain within the spirit and scope of this invention. For instance, electrical contacts $\mathbf{110}_1$, $\mathbf{110}_2$ may be replaced by conventional limit switches that are actuated by rack 74, or a projection thereof, when rack 74 reaches its predetermined limit of travel in each respective direction.

Accordingly, in operation, a user selects to raise the pantograph that is mounted on a train from a lowered position to a raised position. A command input signal is generated in response to the user's selection, and is delivered to a control circuit on the train. The control circuit receives the input command signal and generates a control signal in response. The control signal is sent to a motor, which is responsive to and activated by the control signal. The rotation of an output shaft of the motor causes a worm gear to rotate, which causes a gear set to rotate, which then imparts movement onto a rack gear. The control circuit is also configured to generate a sound control signal corresponding to the raising, lowering, or stopping of the pantograph. This signal is received by an audio circuit, which then plays the appropriate sound corresponding to the pantographs operation.

As the rack moves, it causes an articulating upper portion of the pantograph to raise. When the rack comes to a predetermined limit of travel, which corresponds to the pantograph being in a fully raised position, a limit sense assembly generates a limit signal indicating the rack has reached its limit of travel. This signal is received by the control circuit which is operative to discontinue the control signal provided to the motor and to send a sound signal indicating the stopping of pantograph movement, thereby causing the motor and the sound to stop. The pantograph is then held in a raised position by a pair of compression springs acting on the link between the rack and the articulating upper portion until the user desires to lower the pantograph.

When a user selects an input to lower the pantograph, a similar process is followed. A command input signal is generated in response to the user's selection, and is delivered to a control circuit on the train. The control circuit receives the input command signal and generates a control signal in response. The control signal is sent to a motor, which is activated by the control signal. The rotation of an output shaft of the motor, which is in the opposite direction of the rotation for raising the pantograph, causes a worm gear to rotate, which causes a gear set to rotate, which then imparts movement onto a rack gear. As the rack moves, it causes the articulating upper portion of the pantograph to collapse. When the rack comes to a predetermined limit of travel, which corresponds to the pantograph being in a fully lowered position, the limit sense assembly generates a limit signal indicating the rack has reached its limit of travel. This signal is received by the control circuit which is operative to discontinue the control signal provided to the motor, thereby causing the motor to stop.

It should be noted that while the above description discusses a model train having one pantograph device, in reality, two devices may be used on a single train. In actual industrial trains, two pantographs are often used, one being raised to facilitate travel of the train in one direction (i.e., forward), the other being raised to facilitate travel of the train in a second direction (i.e., reverse). In an exemplary two pantograph arrangement, a second pantograph would be mounted on train 16 on longitudinal plane 78 of base 68 next to the pantograph described above, and would include the same structural elements and would operate in the same manner. The two pantographs could be raised at the same time, lowered at the same time, or one could be raised while the other is lowered. Additionally, the two pantographs may be arranged in various ways, such as, for example, with one pantograph at one end of the a locomotive of the train 16 and the other pantograph positioned at the opposite end of the locomotive.

Having thus described a preferred embodiment of a model vehicle with an automated pantograph, it should be apparent to those skilled in the art that certain advantages of the within system have been achieved. It should also be appreciated that various modifications, adaptations, and alternative embodiments thereof may be made within the scope and spirit of the present invention. For example, a particular pantograph mechanism has been illustrated, but it should be apparent that the inventive concepts described above would be equally applicable to other pantograph mechanisms. The invention is defined by the following claims.

What is claimed is:

1. A model vehicle, comprising:

a reduced-scale model vehicle;

a reduced-scale model pantograph mounted to the model vehicle and disposed over a roof of the model vehicle, wherein the model pantograph comprises a plurality of articulating arms;

a motorized drive unit mounted to the model vehicle and operably associated with the model pantograph so as to extend and retract the plurality of articulating arms from the model vehicle; and an elastic coupling interposed between the motorized drive unit and the plurality of articulating arms, wherein the elastic coupling is configured to permit elastic articulation of the plurality of articulating arms independently of input from the motorized drive unit, wherein the elastic coupling comprises a frame having a traveler in operative communication with an elastic member, wherein the frame is operably associated with an output of the motorized drive unit and the traveler is operably associated with an input of the plurality of articulating arms, the traveler comprises a sliding traveler, the sliding traveler is disposed between opposing springs, and wherein the sliding traveler is disposed on a rod supported by the frame.

2. A model vehicle, comprising:

a reduced-scale model vehicle;

a reduced-scale model pantograph mounted to the model vehicle and disposed over a roof of the model vehicle, wherein the model pantograph comprises a plurality of articulating arms;

a motorized drive unit mounted to the model vehicle and operably associated with the model pantograph so as to extend and retract the plurality of articulating arms from the model vehicle;

a control circuit operably coupled to the motorized drive unit, the control circuit being adapted to receive remotely transmitted command signals to selectively cause the articulating arms to extend and retract; and a breakaway coupling interposed between the motorized drive unit and the plurality of articulating arms, wherein the breakaway coupling comprises a reversible connector configured to disconnect the plurality of articulating arms from the model vehicle when a force exceeding a threshold amount is applied to the plurality of articulating arms.

3. The model vehicle of claim 2, wherein the reversible connector comprises a projecting member urged elastically against a receiving member.

4. The model vehicle of claim 2 wherein the reversible connector comprises a plurality of projecting members urged elastically against a corresponding plurality of receiving members.

5. A model vehicle, comprising:

a reduced-scale model vehicle;

a reduced-scale model pantograph mounted to the model vehicle and disposed over a roof of the model vehicle, wherein the model pantograph comprises a plurality of articulating arms;

a motorized drive unit mounted to the model vehicle and operably associated with the model pantograph so as to extend and retract the plurality of articulating arms from the model vehicle; and a breakaway coupling interposed between the motorized drive unit and the plurality of articulating arms, wherein the breakaway coupling comprises a reversible connector configured to disconnect the plurality of articulating arms from the model vehicle when a force exceeding a threshold amount is applied to the plurality of articulating arms, wherein the reversible connector comprises a pin urged against a receiving surface of a detent by an elastic spring.

6. The model vehicle of claim 2, further comprising an elastic coupling interposed between the motorized drive unit and the plurality of articulating arms, wherein the elastic coupling is separate from the breakaway coupling and is configured to permit elastic articulation of the plurality of articulating arms independently of input from the motorized drive unit.

* * * * *